United States Patent [19]

Kholin

[11] Patent Number: 4,709,685

[45] Date of Patent: Dec. 1, 1987

[54] BALLS THROWING DEVICE

[75] Inventor: Boris G. Kholin, Sumy, U.S.S.R.

[73] Assignee: Sumsky Filial Kharkovskogo Politekhnicheskogo Instituta, Sumy, U.S.S.R.

[21] Appl. No.: 878,378

[22] PCT Filed: Oct. 24, 1984

[86] PCT No.: PCT/SU84/00055

§ 371 Date: Jun. 6, 1986

§ 102(e) Date: Jun. 6, 1986

[87] PCT Pub. No.: WO86/02572

PCT Pub. Date: May 9, 1986

[30] Foreign Application Priority Data

Apr. 19, 1985 [CA] Canada ..... 479629
Apr. 19, 1985 [FR] France ..... 85 05993

[51] Int. Cl.[4] ..... A63B 69/40

[52] U.S. Cl. ..... 124/7; 124/50; 124/39; 273/26 D

[58] Field of Search ..... 124/7, 16, 24, 50, 26, 124/39, 81, 1; 273/26 D

[56] References Cited

U.S. PATENT DOCUMENTS

| | | | |
|---|---|---|---|
| 1,201,626 | 10/1916 | Reynolds | 273/26 D X |
| 1,478,350 | 12/1923 | Okel | 124/50 X |
| 2,792,822 | 5/1957 | Ponza | 124/7 |
| 3,610,223 | 10/1971 | Green | 124/16 |
| 3,777,733 | 12/1973 | Mitchell | 124/16 |
| 3,809,047 | 5/1974 | Hess | 124/1 |
| 3,867,921 | 2/1975 | Politzer | 124/26 |
| 4,262,648 | 4/1981 | Wegener et al. | 273/26 D X |
| 4,501,257 | 2/1985 | Kholin | 124/81 |

FOREIGN PATENT DOCUMENTS

| | | | |
|---|---|---|---|
| 0052904 | 6/1982 | European Pat. Off. . | |
| 2218113 | 9/1974 | France . | |
| WO86/02010 | 4/1986 | World Int. Prop. O. | 124/50 |
| 2118443 | 11/1983 | United Kingdom . | |

*Primary Examiner*—Richard J. Scanlan, Jr.
*Assistant Examiner*—Anthony Knight
*Attorney, Agent, or Firm*—McAulay, Fields, Fisher, Goldstein & Nissen

[57] ABSTRACT

A ball throwing device comprising a pusher (16) operatively associated with a striker (12) through a timing mechanism (21) which incorporates a crank (22) set on a drive axle (23) and linked to the pusher (16). The crank (22) is adapted to rotate together with the drive axle (23) at the same speed, and also at a speed higher than the axle speed when the pusher (16) causes the ball (6) to move to the stroke position. Respective projections (31, 32) are provided on the drive axle (23) and on the crank (22), adapted to interact with each other. Such a projection (33) is also formed on the striker (12), while a yoke (36) is fixed stationary on the casing of the drive (24) and a spring-actuated stop (34) is made on the crank (22), the stop being adapted to interact with the striker projection (33) and with the yoke (36).

6 Claims, 2 Drawing Figures

BALL THROWING DEVICE

TECHNICAL FIELD

This invention relates to sports training gears, and more specifically it concerns a device for throwing or ejecting balls.

PRIOR ART

Known in the present state of the art is a ball throwing device (of., e.g., French Pat. No. 2,218,113, Int. Cl. A 63 B 69/38, 1974) which comprises a base, a separator mounted on the base and adapted for one-by-one delivery of balls, as well as a striker adapted to eject the ball and set on the drive shaft so as to rotate in a plane square with the drive shaft axis. Located at an exit opening of the separator provided with a chute, is a pusher shaped as a solenoid-operated plunger, which is adapted to feed balls from the separator chute to the striker rotary motion pathway within the zone where the striker hits the ball. In addition, the pusher is operatively associated with the striker through the agency of the timing mechanism.

The timing mechanism of the known ball throwing device comprises a time delay device which is in fact a time delay. The time delay device is adapted for control of the ball throwing time, i.e., the time interval between the two consecutively ejected balls.

The timing mechanism incorporates also a cam set on the drive shaft, and a contact provided on the baseframe and adapted for interacting with the cam when the latter rotates along with the drive shaft. The contact makes during each complete revolution of the cam together with the drive shaft on which the striker is fitted rigidly. The contact is electrically connected to the drive of the ball ejecting pusher and also to the time delay device. The pusher drive is in effect a solenoid.

The time delay device ensures that electric current in conducted to the solenoid actuator at time intervals equal to a preset frequency of ball throwing rather than at each contact making by the cam.

To provide precise operation of the timing mechanism described above, pin-point accuracy of its adjustment is involved, i.e., a mutual position of the contact and the cam should be set very precisely, and precise correlation between the cam operation time and the time delay device operation time. Furthermore, for a preset striker rotation frequency one must so calculate or select experimentally the time of the pusher solenoid actuator engagement that, making due account of the ball mass and elasticity, the mass a strike solenoid movable components and mains voltage, the ball would be ejected by the pusher into the zone of at the instant when the moving striker would occur there. Otherwise the ball either will be short of the strike zone most proper for a strike to deliver, or will overtravel that zone, with the result that the ball either will be struck or hit but ineffectively, or be ejected in random direction.

The complicity of such an adjustment is self-evident; it becomes still higher if one takes into account of routine mains voltage fluctuations and the resultant variations of the solenoid pull and hence the ball translational velocity, while effective operation of the ball throwing device becomes less reliable accordingly. Application of an electronic or electromechanical time delay device renders repairs and maintenance more complicated as involving the use of a specialist.

ESSENCE OF THE INVENTION

It is therefore a primary and essential object of the present invention to provide a ball throwing device, wherein the timing mechanism will have a rather simple and reliable construction.

The aforementioned object is accomplished due to the provision of a balls throwing device, comprising a separator for one-by-one delivery of balls, said separator being associated with a base, a striker fitted on a base-supported drive shaft for angular movement in a plane square with the drive shaft, and a spring-actuated pusher located at the separator exit opening and adapted for displacing balls to the position of their delivery (that is, the stroke position), said pusher being operatively associated with the striker through a timing mechanism that brings the motion of said pusher and said striker in synchronism, wherein according to the invention, said timing mechanism comprises a crank mchanically linked to the pusher and set on a drive axle which rests upon the base, is arranged substantially parallel to the drive shaft and rotates towards the latter, said crank being adapted for conjoint rotation with the drive axle at the same speed, and also at a speed higher than the drive axle speed when the pusher causes the ball to move to the stroke position, for which purpose projections are provided on the drive axle and on the crank, said projections being adapted to interact with each other, another such projection being provided on the striker, while the crank has a spring-actuated stop adapted to interact with the striker projection; provision is also made for a yoke fixed stationary on the casing of the drive and arranged between the crank and the drive shaft and adapted to interact with the stop before the latter starts interacting with the striker projection, the distance between the drive axle axis and the yoke inner surface varying from a length equal to the crank outside radius with the stop extended, at the yoke front end facing the crank, to a length equal to the crank outside radius with the stop sunk, at the yoke back end.

It is due to such a constructional arrangement that the timing mechanism features a fairly simple construction and provides for more reliable operation of the ball throwing device.

PREFERRED EMBODIMENT OF THE INVENTION

The ball throwing device according to the present invention has a base 1 (FIG. 1) which is in fact a trolley indicated with Ref. No. 1 as well, mounted on wheels (not shown) for travelling over a sports ground.

Figure 1:
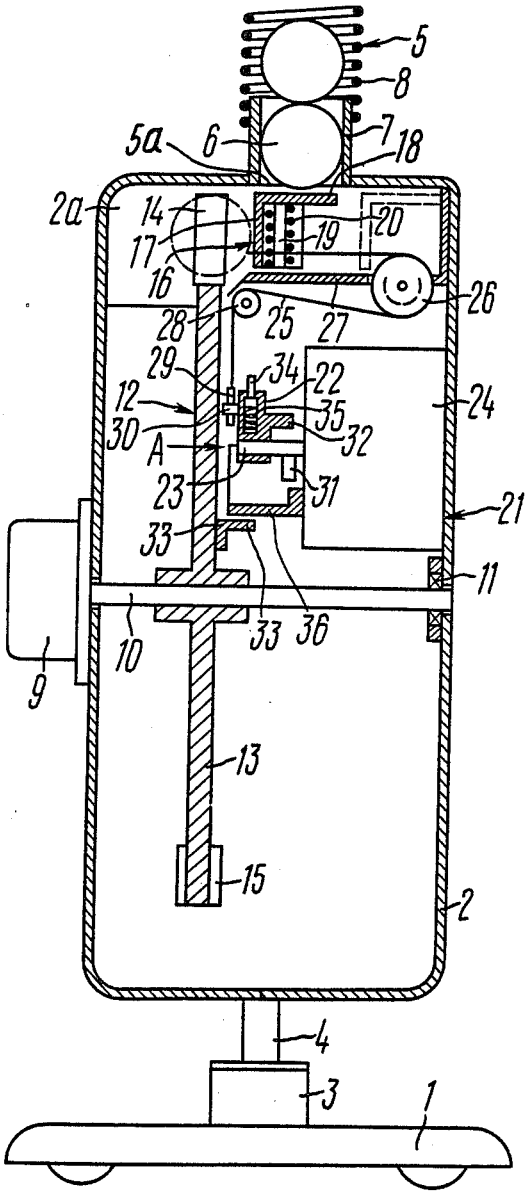
FIG. 1 is a schematic longitudinal-section view of a ball throwing device, according to the present invention.

Hinge-mounted on the base 1 in a bearing unit 3 is a housing 2 which can be swivelled, by virtue of the bearing unit 3, about a vertical (as shown in FIG. 1) pivot 4. The housing 2 is shaped as a cylinder having a horizontal (as shown in FIG. 1) axis. The cylinder ends are essentially vertical (as shown in FIG. 1) walls of the housing 2. An exit opening 2*a* is provided in the housing 2 for the balls being ejected to fly out.

The ball throwing device has a separator 5 for one-by-one delivery of balls 6, said separator having a throat 7 rigidly connected to the housing 2 in its top (as shown in FIG. 1) portion. The separator 5 has also a tube 8 made as a coil spring and adapted for feeding the balls 6 from the hopper (not shown) to the throat 7. Provision of the tube 8 as a coil spring is called forth by a necessity to establish permanent communication between the hopper and the throat 7 when the ball throwing device assumes various positions.

Provision is made for a drive 9 which is in fact an electric motor of any heretofore known construction suitable for the purpose. A drive shaft 10, as well as the drive 9 itself rests upon the housing 2 through bearings 11 of any known construction. The shaft 10 is arranged horizontally and is rotatable at a speed variable with any method known heretofore.

There is provided a striker 12 rigidly fitted on the shaft 10 so as to rotate in a plane square (or normal) with the shaft 10. The striker 12 is in effect a disk 13 at whose periphery a hammer 14 is held, shaped as a rectangular parallelepiped. A balance weight 15 is fastened on the opposite side of the disk 13 in order to eliminate vibration of the shaft 10, the drive 9, and other components linked thereto.

The ball throwing device has a pusher 16 situated at an exit opening 5*a* of the separator 5, that is, at the outlet of the throat 7. the pusher 16 is made as a plate 17 having a baffle 18 arranged at right angles to the plate 17. The baffle 18 is adapted for opening and closing the exit opening 5*a* and is held in position at one end of the plate 17. A rod 19 is made fast on the housing 2 with the aid of any suitable means (not shown), onto which a spring 20 is fitted, adapted to actuate the pusher 16, which in turn feeds the ball 6 to the stroke position shown with a dotted line in FIG. 1. With one of its ends the spring 20 rests against the plate 17, while its other end is connected to the housing 2. The spring 20 is so fitted on the rod 19 that when released its force causes the plate 17 to travel in a direction that provides for displacement of the ball 6 to the stroke position indicated with a dotted line in FIG. 1.

The pusher 16 is operatively associated with the striker 12 through a timing mechanism 21 which brings the motions of the pusher 16 and the striker 12 in synchronism. The timing mechanism 21 comprises a crank 22 set freely, by any known method, on a drive axle 23 having a drive 24 of any known construction suitable for the purpose, which is located on the housing 2. The drive axle 23 is adapted for rotating towards the direction of rotation of the shaft 10.

The crank 22 is mechanically linked to the pusher 16 through a cable 25 guided by a block 26 which is held to a strip 27 rigidly coupled to the housing 2 with the aid of any known means, as well as by a block 28 fixed on the housing 2 with the help of any known means. The cable 25 is connected to the crank 22 through a sleeve 29 which is fitted on a pin 30 provided on the crank 22, the axis of the pin 30 being parallel to the axis of the drive axle 23.

The crank 22 is adapted for conjoint rotation with the drive axle 23 at the same speed, and also at a speed higher than that of the drive axle 23 when the ball 6 is advanced by the pusher 16 to the stroke position. To this end a projection 31 is made on the drive axle 23 nearby the drive 24, while a respective projection 32 is made on the crank 22, both of the projections being adapted to interact with each other.

The disk 13 of the striker 12 has a projection 33 (FIGS. 1, 2) arranged square with the disk 13. A spring-actuated stop 34 having a spring 35 fitted in a seat (no Ref. No) which is provided in the crank 22, is mounted on the latter and adapted for interaction with the projection 33. The stop 34 is shaped as a rod arranged square with the drive axle 23.

An arch-shaped yoke 36 is provided between the crank 22 and the shaft 10 of the drive 9, the yoke 36 being fixed stationary on the housing of the drive 24. The yoke 36 is adapted for interaction with the stop 34 before the interaction of said stop with the projection 33 of the striker 12. The distance between the axis of the drive axle 23 and the inner surface of the yoke 36 varies from a length equal to the outside radius of the crank 22 with the stop extended, at a yoke front end 37 (FIG. 2) facing the crank 22, to a length equal to the outside radius of the crank 22 with the stop 34 sunk, at a yoke back end 38. Such a construction feature is necessary for the spring-actuated stop 34 to sink upon interaction with the inner surface of the yoke 36 when the crank 22 rotates.

The ball throwing device, according to the present invention, operates as follows.

When the drive 9 is engaged the shaft 10 starts rotating along with the striker 12 at a preset rotation frequency. Simultaneously the drive 24 is engaged to set the drive axle 23 together with the projection 31 in rotation at a speed much lower than the speed of rotation of the shaft 10. With the axle 23 rotating the projection 31 gets in contact, in a definite lapse of time, with the projection 32 of the crank 22 which is freely set on the axle 23.

Upon the interaction of the projections 31 and 32 the crank 22 starts rotating along with the axle 23 at the same speed. Next the cable 25 begins tautening to displace the pusher 16 to the position shown with a dotted line in FIG. 1. As a result, the spring 20 gets loaded, thus tending to return the pusher 16 into the initial position, which is prevented by the taut cable 25.

At the same time with the crank 22 rotating, the stop 34 that has been extended by the action of the spring 35, is sunk upon interaction with the inner surface of the yoke 36 to compress the spring 35. On further rotation of the axle 23 and crank 22 the cable 25 and the crank 22 will assume the position shown in FIG. 2. At that instant the tension of the cable 25 called forth by the spring 20, actuates the crank 22, thus forcing the projection 31 of the axle 23 tightly against the projection 32 of the crank 22 so that both of these keeps rotating conjointly.

Figure 2:
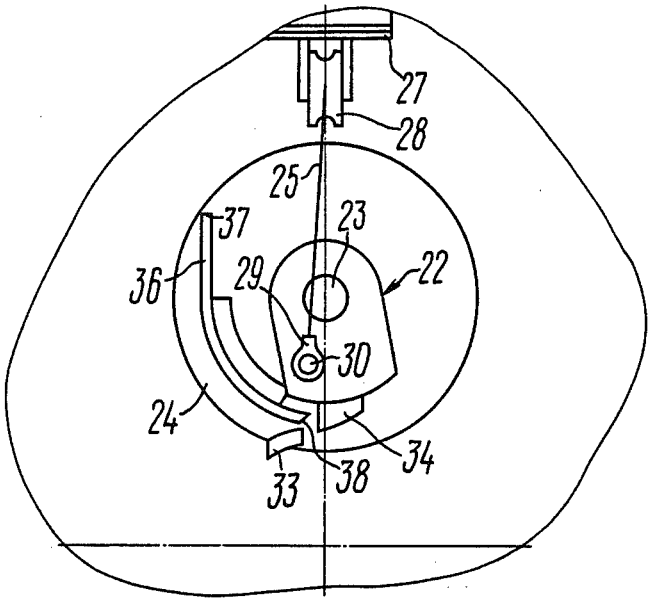
FIG. 2 is a scaled-up view of the timing mechanism, taken along the arrow A of FIG. 1, the respective projections on the drive axle and on the crank being omitted purposely, while the crank stop is purposely shown in the lower position.

Before the crank 22 assumes the bottom (as shown in FIG. 1) position, the cable 25 becomes taut to a greatest extent and the spring 20 gets maximally compressed, the vacant end of the stop 34 reaches the back end 38 of the yoke 36 so that the stop 34 is actuated by the spring 35 to assume, at a high rate, its extreme position as shown in FIG. 2. Since the axle 23 rotates at a much lower speed than the striker 12, the projection 33 of the striker 12 will engage the stop 34 in its extended position in a relatively short lapse of time (shorter than the rotation time of the striker 12), thus imparting an additional speed to the crank 22.

Then the crank 22 actuated by the spring 20 and an impact delivered by the projection 33 starts rotating at an accelerated speed about the axle 23, that is, at a speed higher than that of the axle 23, thus overtaking the latter. As a result, the cable 25 is being slackened and the pusher 16 starts moving impetuously under the action of the spring 20 to displace the ball 6 to the position shown with a dotted line in FIG. 1.

The position of the projection 33 on the striker 12 is so selected that the hammer 14 should assume such a position at the instant when the stop 34 encounters the projection 33 that the ball 6 would have enough time to assume the stroke position indicated with a dotted line in FIG. 1, before the instant when the hammer 14 approaches the zone of stroke.

Once the ball 6 has been displaced completely by the pusher 16 to the stroke position, the hammer 14 delivers a stroke to the ball 6. As a result, the ball 6 acquires a velocity depending upon the linear velocity of the hammer 14 and the elasticity of the ball 6, and is thrown out of the housing 2 through the exit opening *2a*. Thereupon the crank 22 resumes its topmost (as shown in FIG. 1) position. During further operation of the herein-proposed ball throwing device the projection 31 of the axle 23 resumes interaction with the projection 32 of the crank 22, the cable 25 tautens and retracts the pusher 16 to its rightmost (as shown in FIG. 1) position. The next ball 6 is transferred from the throat 7 to the position in front of the pusher, and the entire cycle is repeated. The throwing frequency of the balls 6 is dependent upon the rotation frequency of the axle 23.

The ball throwing device proposed in the present invention is instrumental in increasing accuracy and reliability of ball throwing due to precise synchronism in the motions of the striker and pusher. The device is simple in construction, features low weight and small overall dimensions which enables it to be carried in a car's luggage compartment or on a motor cycle's luggage carrier. The device features high efficiency, whereby a car's or motor cycle's storage battery, or any other low-capacity power source can be used as a power source.

The device of the present invention can find most utility when applied for training tennis-and soccer-players.

Industrial Applicability

The herein-proposed device can find most utility when applied for training tennis-, soccer-, or hockey players.

The ball throwing device implemented according to the present invention, is also applicable for the training process in some other ball games, such as basketball, volleyball, baseball, handball, etc.

What we claim is:

1. A ball throwing device, comprising:

a separator (5) connected to a housing (2) and adapted for one-by-one delivery of balls (6);

a striker (12) fitted on a shaft (10) of a drive (9) for rotating said strike (12) in a plane perpendicular to said shaft (10), said shaft (10) being supported by said housing (2); and a spring-actuated pusher (16) located at an exit opening (5a) of a separator (5) and adapted for displacing the balls (6) to a delivery position by virtue of a stroke, said pusher (16) being operatively associated with said striker (12) through a timing mechanism (21) which brings the motion of said pusher and said striker in synchronism;

said timing mechanism (21) comprising:

a crank (22) mechanically linked to said pusher (16) and mounted on an axle drive (23) of a drive (24) and arranged substantially parallel to said shaft (10) to rotate towards the direction of rotation thereof, said crank (22) being adapted for conjoint rotation with said drive axle (23) at the same speed, and also at a speed higher than that of said drive axle (23) when said pusher (16) causes the balls (6) to move into a stroke position, for which purpose projections (31, 32) are provided on said axle (23) and said crank (22) respectively, which projections being adapted to interact with each other, said striker being provided thereon with another projection (33), while said carnk (22) carries a spring actuated stop (34) adapted to interact with the projection (33);

a yoke (36) fixed on the housing of the drive (24) and arranged between the crank (22) and the shaft (10), said yoke (36) being adapted to interact with the spring-actuated stop (34), before the stop (34) interacts with said other projection (33) of said striker (12); and the distance between the axis of the drive axle (23) and the inner surface of the yoke (36) varying from a length equal to the outside radius of the crank (22) with the spring-actuated stop extended, at the yoke front and facing the crank (22), to a length equal to the outside radius of the crank (22) with the spring-actuated stop (34) in a sunk position, at the yoke back end.

2. A ball throwing device according to claim 1, including a baffle (18) for opening and closing said exit opening and held in position at one end of a plate (17) forming part of said pusher (16).

3. A ball throwing device according to claim 22, wherein said separator includes a tube in the form of a coil spring for feeding of the balls towards said baffle.

4. A ball throwing device according to claim 32, including:

a cable linking said pusher (16) to said crank (22); blocks (26, 28) associated with said housing for guiding said cable; and a pin (30) provided on said crank (22) connected with one end of said cable, the axis of said pin being parallel to the axis of said drive axle.

5. A ball throwing device according to claim 2, including:

a cable linking said pusher (16) to said crank (22); blocks (26, 28) associated with said housing for guiding said cable; and a pin (30) provided on said crank (22) connected with one end of said cable, the axis of said pin being parallel to the axis of said drive axle.

6. A ball throwing device according to claim 1, including:

a cable linking said pusher (16) to said crank (22); blocks (26, 28) associated with said housing for guiding said cable; and a pin (30) provided on said crank (22) connected with one end of said cable, the axis of said pin being parallel to the axis of said drive axle.

* * * * *